US007401474B2

(12) United States Patent
Hsieh et al.

(10) Patent No.: US 7,401,474 B2
(45) Date of Patent: Jul. 22, 2008

(54) THERMAL FOOD STORAGE CABINET

(75) Inventors: Hsin-Mao Hsieh, Ping Tung (TW); Chin-Ho Tsai, Kaohsiung (TW)

(73) Assignee: Adda Corp., Ping Tung (TW)

( * ) Notice: Subject to any disclaimer, the term of this patent is extended or adjusted under 35 U.S.C. 154(b) by 264 days.

(21) Appl. No.: 11/362,167

(22) Filed: Feb. 27, 2006

(65) Prior Publication Data

US 2007/0199343 A1 Aug. 30, 2007

(51) Int. Cl.
*F25D 11/02* (2006.01)

(52) U.S. Cl. ..... 62/441; 62/447

(58) Field of Classification Search ..... 62/441, 62/457.9, 120, 337, 457.5, 447; 312/236, 312/249.4, 401, 407, 403, 410
See application file for complete search history.

(56) References Cited

U.S. PATENT DOCUMENTS 4,317,607 A * 3/1982 Gomolka ..... 312/236
4,793,145 A * 12/1988 Hwang et al. ..... 62/252
5,411,328 A * 5/1995 You ..... 312/405
5,536,081 A * 7/1996 Pokhis ..... 312/321.5
5,605,047 A * 2/1997 Park et al. ..... 62/3.6
5,737,939 A * 4/1998 Valence et al. ..... 62/441
5,921,095 A * 7/1999 Lee et al. ..... 62/175
6,253,568 B1 * 7/2001 Peffley ..... 62/441
6,837,068 B2 * 1/2005 Wood ..... 62/442
7,000,414 B2 * 2/2006 Lee et al. ..... 62/227

FOREIGN PATENT DOCUMENTS

JP 2003-42632 A * 2/2003

* cited by examiner

*Primary Examiner*—Mohammad M. Ali
(74) *Attorney, Agent, or Firm*—Muncy, Geissler, Olds & Lowe, PLLC

(57) ABSTRACT

A thermal food storage cabinet has a sealed box with a thermally insulated compartment, a freezer compartment and a refrigeration compartment, a compressor, a condenser, evaporator and thermal expansion valve. The thermally insulated compartment has a heat-conducting panel. The compressor, the evaporator and the thermal expansion valve are mounted in the thermal food storage cabinet to cool the freezer compartment and the refrigeration compartment. The condenser is mounted on the heat-conducting panel so heat dissipated by the condenser can flow into the thermally insulated compartment.

2 Claims, 5 Drawing Sheets

THERMAL FOOD STORAGE CABINET

BACKGROUND OF THE INVENTION

1. Field of the Invention

The present invention relates to a thermal food storage cabinet, and more particularly to a thermal food storage cabinet that has a freezer, a chill box and a thermally insulated compartment.

2. Description of the Related Art

Conventional refrigerators use refrigerant to cool the refrigerator and have a bottom, a rear surface, a freezer, a chill box, a compressor, a condenser, an evaporator and a thermal expansion valve. The freezer is insulated and has a front, a door, an inside surface and an outside surface. The door is insulated, is mounted on the front of the freezer and seals the freezer when closed. The chill box is insulated, is usually mounted below the freezer and has a front, a door, an inside surface and an outside surface. The compressor increases pressure on refrigerant and is usually mounted at the bottom of the refrigerator under the chill box. The condenser converts gaseous refrigerant to liquid refrigerant, is mounted on the rear surface of the refrigerator to dissipate heat to the ambient environment, is connected to the compressor and has multiple fins. The fins dissipate heat to the ambient environment. The evaporator is mounted in the freezer, the chill box or both, is connected to the compressor and the condenser and absorbs heat in the freezer and the chill box. The thermal expansion valve controls cooling in the freezer and the chill box, is mounted between the compressor and the evaporator and releases and atomizes pressurized liquid refrigerant into the evaporator. However, heat generated by the condenser is useless in the conventional refrigerator. Furthermore, fins mounted on the condenser increase the cost of the refrigerator. Therefore, the invention provides a thermal food storage cabinet to mitigate or obviate the aforementioned problems.

SUMMARY OF THE INVENTION

The main objective of the present invention is to provide a thermal food storage cabinet that can freeze food, cool food and maintain the temperature of heated food.

A thermal food storage cabinet has a sealed box with a thermally insulated compartment, a freezer compartment and a refrigeration compartment, a compressor, a condenser, evaporator and thermal expansion valve. The thermally insulated compartment has a heat-conducting panel. The compressor, the evaporator and the thermal expansion valve are mounted in the thermal food storage cabinet to cool the freezer compartment and the refrigeration compartment. The condenser is mounted on the heat-conducting panel so heat dissipated by the condenser can flow into the thermally insulated compartment. The present invention can store food as desired.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
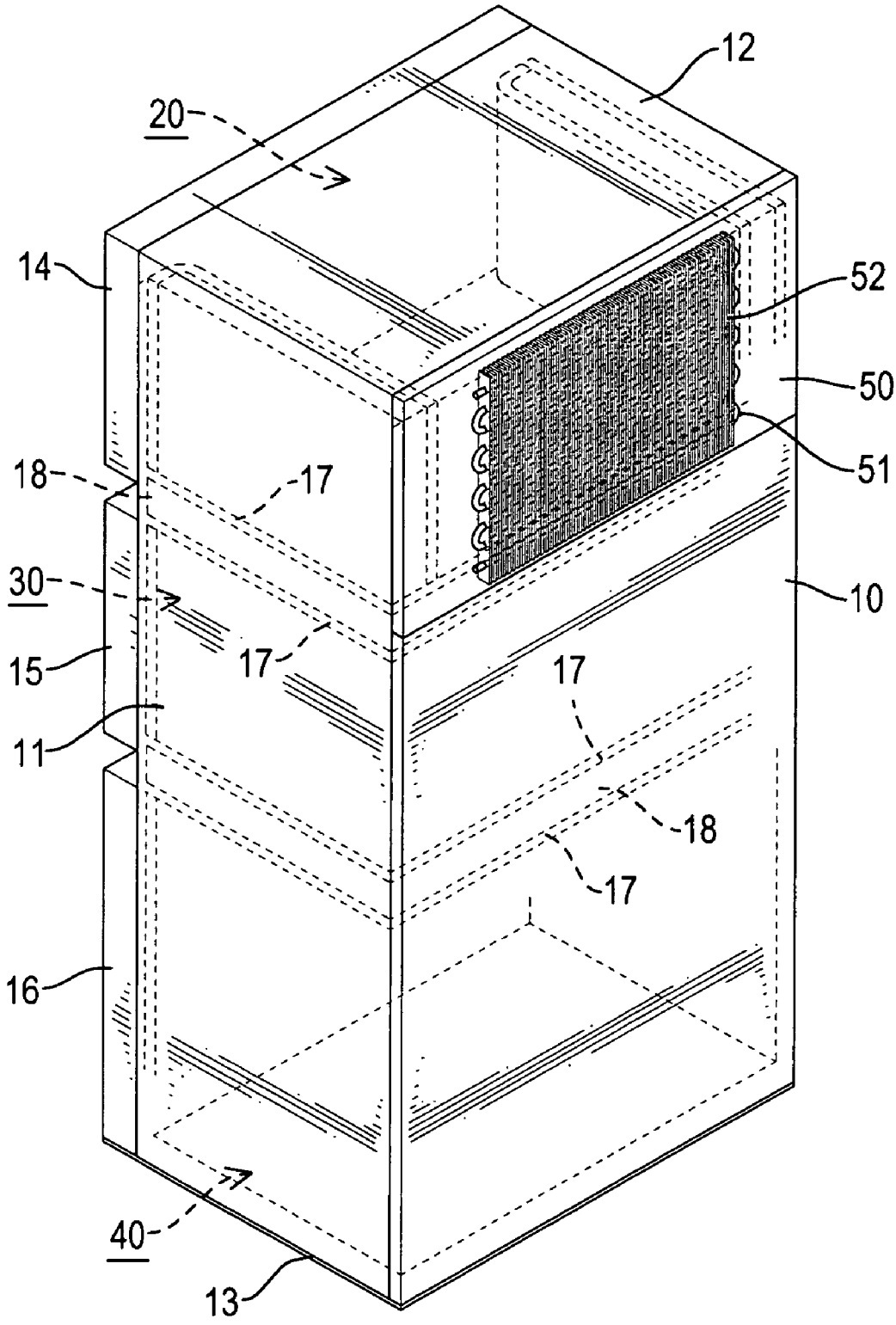
FIG. 1 is a perspective view of a thermal food storage cabinet in accordance with the present invention.
Figure 2:
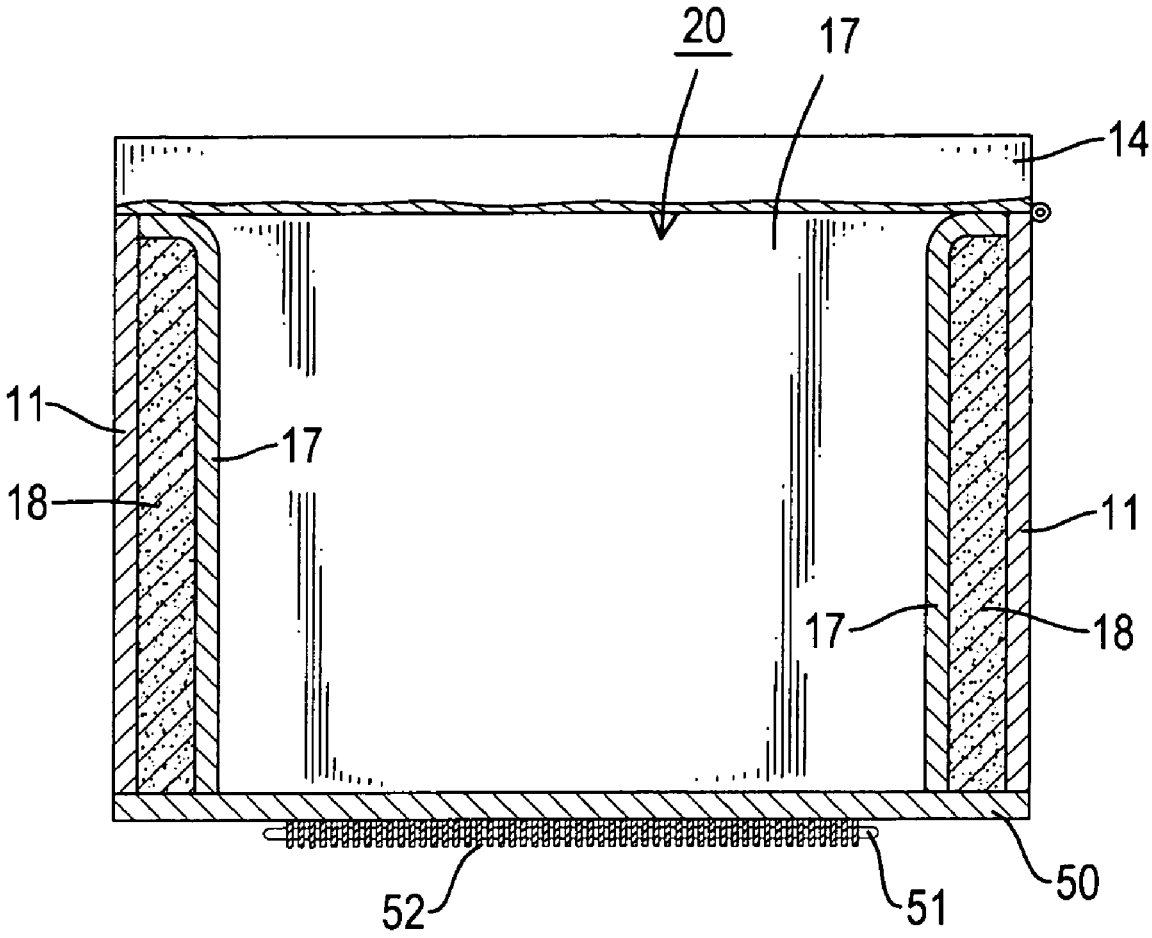
FIG. 2 is a top view in partial section of the thermal food storage cabinet in FIG. 1.
Figure 3:
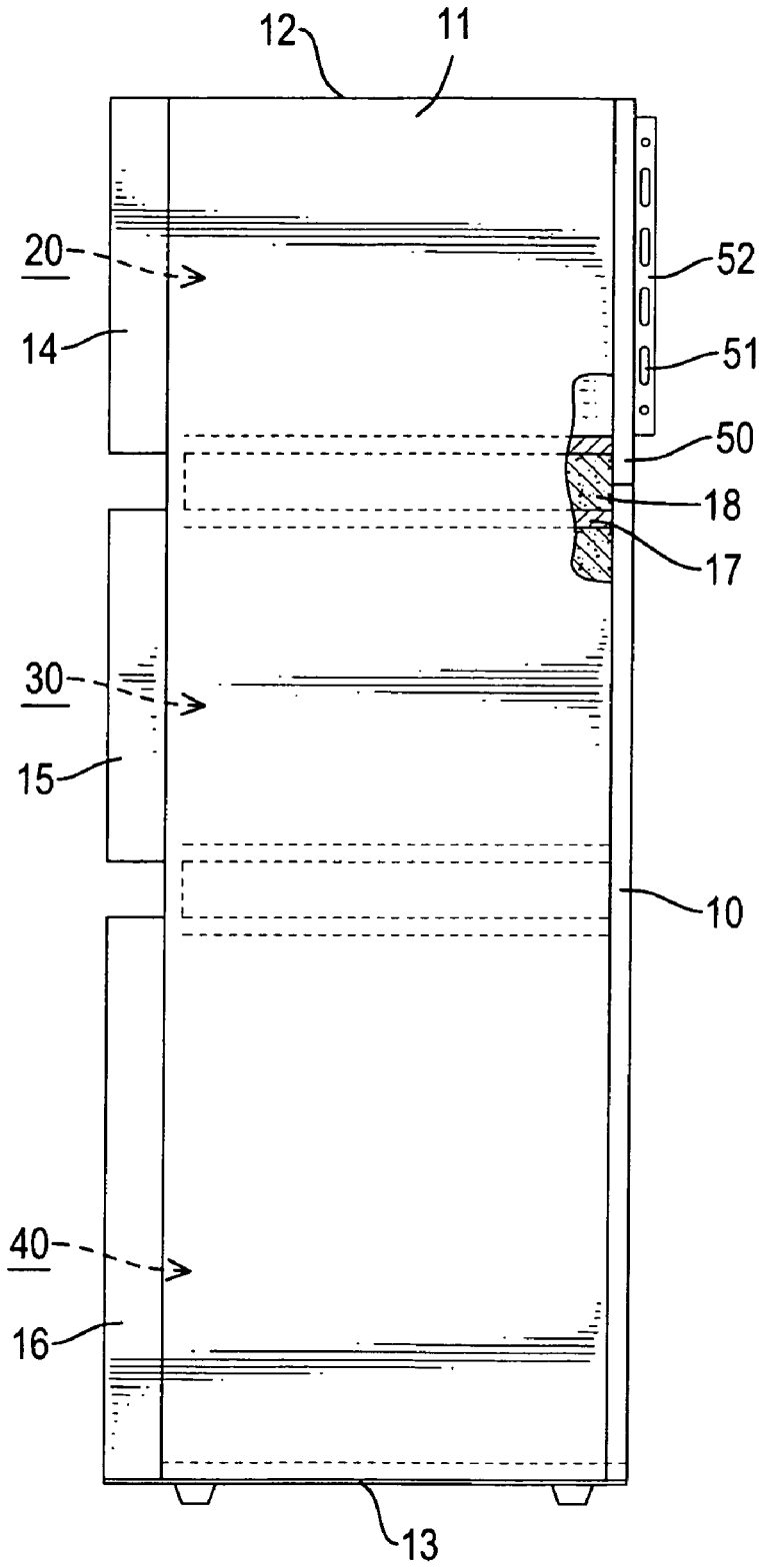
FIG. 3 is a side view in partial section of the thermal food storage cabinet in FIG. 1.

With reference to FIGS. 1 to 3 and 5, a thermal food storage cabinet comprises a sealed box, a compressor, a condenser (51), an evaporator, a thermal expansion valve and an optional rear cover (60).

The sealed box has a top (12), a bottom, a front, a rear (10), two sides (11), a base (13), an upper door (14), a middle door (15), a bottom door (16), an interior compartment, multiple horizontal partitions (17) and multiple thermal insulation layers (18). The front of the sealed box has an upper opening, a middle opening and a lower opening. The base (13) is formed at the bottom of the sealed box. The upper door (14) is attached pivotally to the front of the sealed box and selectively covers and seals the upper opening. The middle door (15) is attached pivotally to the front of the sealed box and selectively covers and seals the middle opening. The bottom door (16) is attached pivotally to the front of the sealed box and selectively covers and seals the lower opening. The horizontal partitions (17) are attached to the front, sides and rear of the sealed box and are mounted in pairs separated by a gap in the interior compartment of the sealed box respectively between the openings in the front and form a thermally insulated compartment (20), a freezer compartment (30) and a refrigeration compartment (40). The thermally insulated compartment (20) corresponds to the upper opening in the front of the sealed box and has an open rear and a heat-conducting panel (50). The heat-conducting panel (50) is mounted on and seals the open rear of the thermally insulated compartment (20). The freezer compartment (30) corresponds to the middle opening in the front of the sealed box. The refrigeration compartment (40) corresponds to the lower opening in the front of the sealed box. The thermal insulation layers (18) are mounted respectively in the gaps between the pairs of horizontal partitions (17) that separate the thermally insulated compartment (20), the freezer compartment (30) and the refrigeration compartment (40).

The compressor is mounted in the sealed box at the bottom.

The condenser (51) is mounted on the heat-conducting panel (50), provides heat to the thermally insulated compartment (20), is connected to the compressor and has an outer wall and multiple fins (52). The fins (52) are mounted in parallel on the outer wall of the condenser (52) and dissipate excess heat to the ambient environment The evaporator is mounted between the freezer compartment (30) and the refrigeration compartment (40) and is connected to the compressor and the condenser (51).

The thermal expansion valve controls cooling in the freezer compartment (30) and the refrigeration compartment (40) and is mounted between the compressor and the evaporator.

Figure 4:
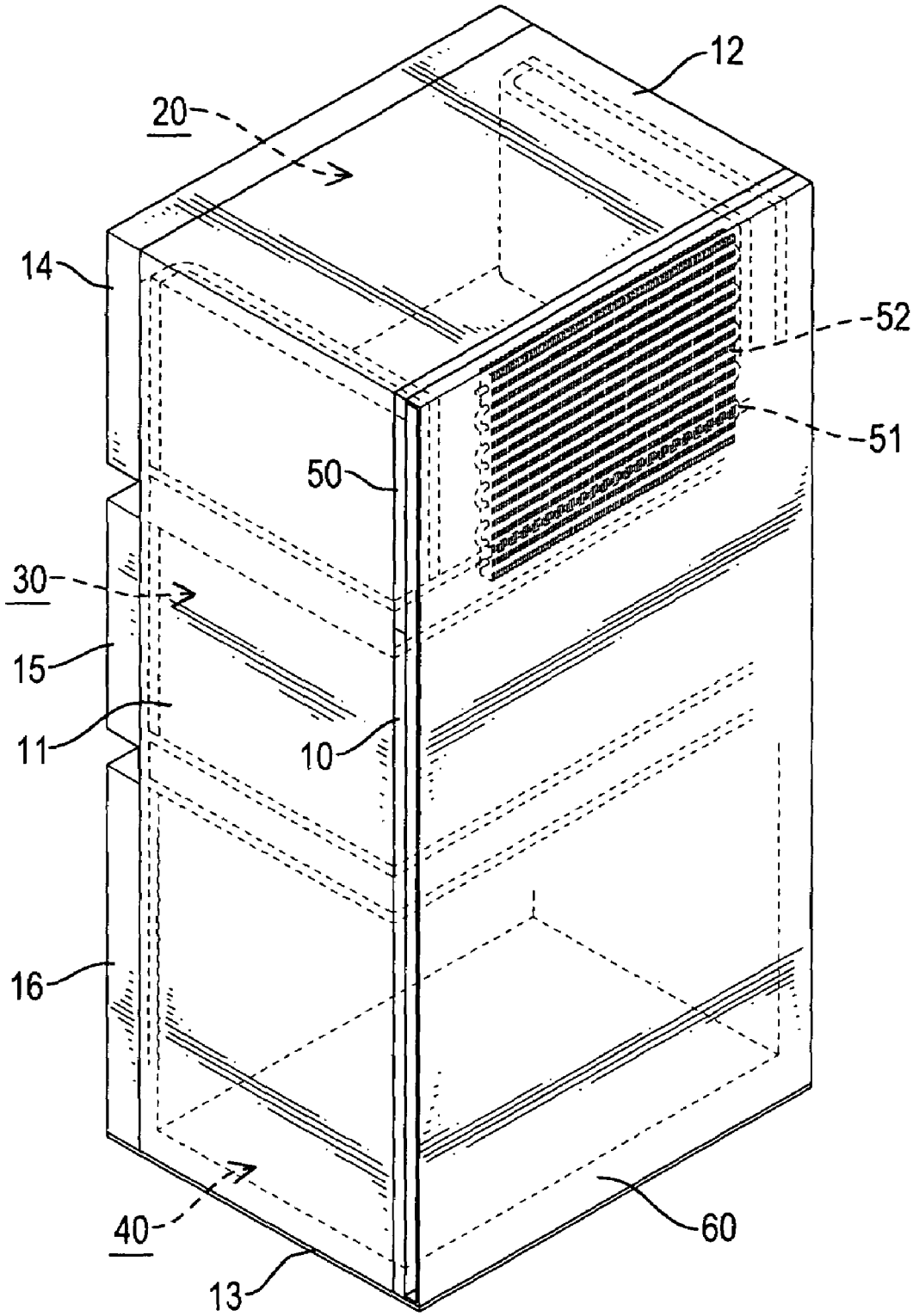
FIG. 4 is a perspective view of the thermal food storage cabinet in FIG. 1 with a decorative panel a rear side surface of the thermal food storage cabinet.
Figure 5:
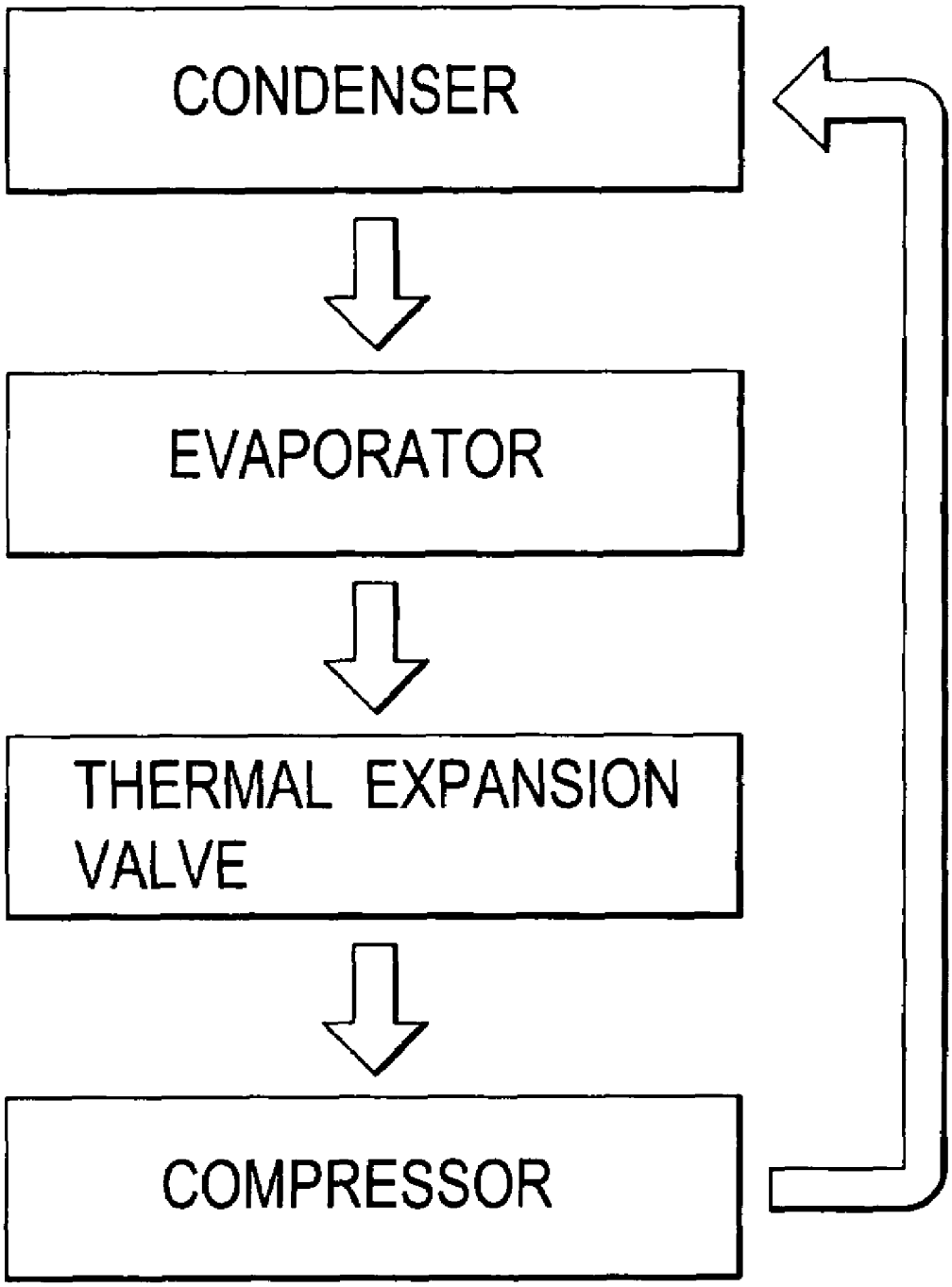
FIG. 5 is block diagram of the thermal food storage cabinet in FIG. 1.

With further reference to FIG. 4, the rear cover (60) is mounted on the rear of the sealed box to cover the condenser (51) and improve the aesthetic appearance of the thermal food storage cabinet.

The thermal food storage cabinet as described has the following advantages.

1. The thermal food storage cabinet has a thermally insulated compartment, a refrigeration compartment and a freezer compartment to store food as desired.

2. Heat drawn from the refrigeration compartment and the freezer compartment is used to heat the thermally insulated compartment.

Even though numerous characteristics and advantages of the present invention have been set forth in the foregoing description, together with details of the structure and function of the invention, the disclosure is illustrative only. Changes may be made in details, especially in matters of shape, size, and arrangement of parts within the principles of the invention to the full extent indicated by the broad general meaning of the terms in which the appended claims are expressed.

What is claimed is:

1. A thermal food storage cabinet comprising:

a sealed box having a top;

a bottom;

a front having an upper opening;

a middle opening; and a lower opening;

a rear;

two sides;

a base being formed at the bottom of the sealed box;

an upper door being attached pivotally to the front of the sealed box and covering and sealing the upper opening;

a middle door being attached pivotally to the front of the sealed box and covering and sealing the middle opening;

a bottom door being attached pivotally to the front of the sealed box and covering and sealing the lower opening;

an interior compartment;

multiple horizontal partitions being attached to the front, sides and rear of the sealed box and being mounted in pairs separated by a gap in the interior compartment of the sealed box respectively between the openings in the front and forming a thermally insulated compartment corresponding to the upper opening in the front of the sealed box and having an open rear; and a heat-conducting panel being mounted on and sealing the open rear of the thermally insulated compartment;

a freezer compartment corresponding to the middle opening in the front of the sealed box; and a refrigeration compartment corresponding to the lower opening in the front of the sealed box; and multiple thermal insulation layers being mounted respectively in the gaps between the pairs of horizontal partitions that separate the thermally insulated compartment, the freezer compartment and the refrigeration compartment;

a compressor being mounted in the sealed box at the bottom;

a condenser mounted on the heat-conducting panel, being connected to the compressor and having an outer wall; and multiple fins being mounted in parallel on the outer wall of the condenser;

an evaporator being mounted between the freezer compartment and the refrigeration compartment and being connected to the compressor and the condenser; and a thermal expansion valve controlling cooling in the freezer compartment and the refrigeration compartment and being mounted between the compressor and the evaporator.

2. The thermal food storage cabinet as claimed in claim 1 further comprising a rear cover being mounted on the rear of the sealed box.

* * * * *